US012241208B2

(12) United States Patent
Boeck

(10) Patent No.: US 12,241,208 B2
(45) Date of Patent: Mar. 4, 2025

(54) TAMPING UNIT AND METHOD FOR TAMPING SLEEPERS OF A TRACK

(71) Applicant: PLASSER & THEURER EXPORT VON BAHNBAUMASCHINEN GMBH, Vienna (AT)

(72) Inventor: Reinhard Boeck, Aschach An der Donau (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 940 days.

(21) Appl. No.: 17/277,393

(22) PCT Filed: Aug. 13, 2019

(86) PCT No.: PCT/EP2019/071641

§ 371 (c)(1),
(2) Date: Mar. 18, 2021

(87) PCT Pub. No.: WO2020/057865

PCT Pub. Date: Mar. 26, 2020

(65) Prior Publication Data

US 2021/0355638 A1 Nov. 18, 2021

(30) Foreign Application Priority Data

Sep. 18, 2018 (AT) ..... A 290/2018

(51) Int. Cl.
*E01B 27/17* (2006.01)
*E01B 27/16* (2006.01)

(52) U.S. Cl.
CPC ..... *E01B 27/17* (2013.01); *E01B 27/16* (2013.01); *E01B 2203/12* (2013.01)

(58) Field of Classification Search
CPC ..... E01B 27/17; E01B 2203/12; E01B 27/16
(Continued)

(56) References Cited

U.S. PATENT DOCUMENTS 7,075,427 B1 * 7/2006 Pace ..... B61L 23/06 246/126
9,957,668 B2 5/2018 Lichtberger
(Continued)

FOREIGN PATENT DOCUMENTS

AT 518025 A1 6/2017
CA 3107671 A1 * 3/2020 ..... E01B 27/16
(Continued)

*Primary Examiner* — Zachary L Kuhfuss
*Assistant Examiner* — Heaven R Buffington
(74) *Attorney, Agent, or Firm* — Laurence A. Greenberg; Werner H. Stemer; Ralph E. Locher

(57) ABSTRACT

A tamping unit for tamping sleepers of a track includes a tool carrier supported in a lowerable manner on an assembly frame, on which two pivot levers with tamping tools are mounted so as to be squeezable toward one another and, while being actuatable with a vibration, are rotatable about a respective rotation axis. A sensor for recording a pivot angle of a pivoting motion about the related rotation axis is associated with at least one pivot lever. The sensor has a multipart configuration with a first sensor part fastened to the tool carrier and a second sensor part fastened to the pivot lever. In this manner, sensitive sensor components in the first sensor part are subjected to lessened stress since the tool carrier merely performs a lowering or lifting motion during a tamping operation. A method for operating the tamping unit is also provided.

6 Claims, 2 Drawing Sheets

(58) Field of Classification Search
USPC ..... 104/10
See application file for complete search history.

(56) References Cited

U.S. PATENT DOCUMENTS

| | | | | |
|---|---|---|---|---|
| 10,808,362 | B2 | 10/2020 | Seyrlehner | |
| 11,821,147 | B2 * | 11/2023 | Kopf | E01B 27/17 |
| 2017/0074680 | A1 * | 3/2017 | Reymond | G01R 33/072 |

FOREIGN PATENT DOCUMENTS

| | | | | | |
|---|---|---|---|---|---|
| CN | 101782367 | A | | 7/2010 | |
| CN | 202916644 | U | * | 5/2013 | |
| CN | 103335665 | A | | 10/2013 | |
| CN | 106458235 | A | * | 2/2017 | B61K 9/08 |
| CN | 108291368 | A | | 7/2018 | |
| CN | 108708751 | A | | 10/2018 | |
| EP | 2770108 | A1 | | 8/2014 | |
| EP | 3239398 | A1 | | 11/2017 | |
| GB | 2524027 | A | * | 9/2015 | E01B 35/12 |
| JP | 2002146702 | A | | 5/2002 | |
| SU | 1114716 | A1 | | 9/1984 | |
| WO | 2017097390 | A1 | | 6/2017 | |

* cited by examiner

TAMPING UNIT AND METHOD FOR TAMPING SLEEPERS OF A TRACK

BACKGROUND OF THE INVENTION

Field of the Invention:

The invention relates to a tamping unit for tamping sleepers of a track, including a tool carrier, supported in a lowerable manner on an assembly frame, on which two pivot levers with tamping tools are mounted so as to be squeezable toward one another and—actuatable with a vibration—rotatable about a respective rotation axis, wherein a sensor for recording a pivot angle of a pivoting motion about the related rotation axis is associated with at least one pivot lever. The invention additionally relates to a method of operating the tamping unit.

Description of the Related Art

For restoring or maintaining a prescribed track position, tracks having a ballast bed are regularly treated by means of a tamping machine. During this, the tamping machine travels on the track and lifts the track grid formed of sleepers and rails to a target level by means of a lifting-/lining unit. A fixation of the new track position takes place by tamping the sleepers by means of a tamping unit. During the tamping procedure, tamping tools (tamping tines) actuated with a vibration penetrate between the sleepers into the ballast bed and consolidate the ballast underneath the respective sleeper in that oppositely positioned tamping tools are squeezed towards one another. In this, the squeezing motions and the superimposed vibration motions follow an optimized motion pattern in order to achieve the best possible consolidation results of the ballast bed. A vibration frequency of, for example, 35 Hz during a squeezing procedure has proven to be optimal. For precise motion control it is therefore useful to continuously report a current tamping tool position back to a control device in order to be able to make readjustments in the case of deviations from the optimized motion pattern.

According to AT 518 025 A1, a tamping unit is known which has two oppositely positioned pivot levers with tamping tools fastened thereon. The pivot levers are mounted on a lowerable tool carrier to be rotatable about a respective rotation axis and are coupled to a squeezing drive as well as to a vibration drive. Determining the current position of the respective tamping tool takes place by determining the angular position of the associated pivot lever by means of an angle sensor arranged in the pivot axis. In this, there is the disadvantage that the angle sensor is subjected to high vibration stress.

SUMMARY OF THE INVENTION

It is the object of the invention to provide improved recording of the respective tamping tool position for a tamping unit of the type mentioned at the beginning. Further, a method for operating the improved tamping unit is to be described.

According to the invention, these objects are achieved by way of a tamping unit and a method described below. Dependent claims indicate advantageous embodiments of the invention.

In this, it is provided that the sensor is of multi-part design, that a first sensor part is fastened to the tool carrier, and that a second sensor part is fastened to the pivot lever. In this manner, sensitive sensor components in the first sensor part are subjected to lessened stress since the tool carrier performs merely a lowering- or lifting motion during a tamping operation. Only the second sensor part moves along with the associated pivot lever and is subjected to the vibration- and squeezing stresses. Overall, the service life of the sensor is thus increased as compared to known solutions.

In an advantageous further development, the first sensor part comprises active electronic components, and the second sensor part comprises merely passive components without any electricity supply. As a result of this measure, there is no necessity to lead a supply cable to the vibration-stressed pivot levers. Thus, there is no danger of a ruptured cable due to high mechanical stress.

Favourably, the first sensor part comprises as an active component a magnetic sensor, and the second sensor part comprises as a passive component a permanent magnet. With this arrangement, a very precise registration of an angular position of the respective pivot lever is ensured.

A further improvement of the tamping unit is achieved in that the first.

sensor part comprises a motion sensor. In this manner, the lowering- and lifting motions of the tamping tools or the tool carrier can also be recorded by means of the sensor in addition to the squeezing- and vibration motions. The sensor delivers all measuring signals which are required for continuous motion monitoring of the tamping unit.

In this, it is favourable if the motion sensor is constructed as an integrated component. This allows a space-saving integration into the structural configuration of the sensor and a simple processing of the generated motion data.

For comprehensive location- and position determination, it is advantageous if the motion sensor comprises three acceleration sensors and three gyroscopes. With this, all possible motions in the three-dimensional space can be recorded. Also, lateral motions of the tamping unit or rotations about a vertical axis are recorded in order to adapt control specifications or to document the progress of a tamping operation.

Advantageously, the first sensor part includes a microcontroller. By means of the microcontroller, data are merged already in the sensor and evaluated in advance. Thus, the possibility is created to adapt the processing of the emitted measuring data or measuring signals to an input interface of a control device.

In a particularly robust design of the sensor, the first sensor part has a circuit board which is arranged in a sealed enclosure and cast in a protective medium. Thus, is ensured that vibrations possibly transmitted to the tool carrier are without effect on the first sensor part.

In this, it is advantageous if a serial interface is arranged on the circuit board. This can be used to program or configure the sensor prior to its use and optionally before the circuit board is cast. Favourably, the serial interface has contact plugs for connection of a data cable.

Additionally, it is advantageous if the first sensor part has a bus interface, in particular a CAN interface. This interface can be used for data exchange with a control device. Furthermore, this interface can also be designed for programming or configuring the sensor.

Reasonably, the bus interface is connected to a bus cable which is guided out of an enclosure of the first sensor part through a sealed passage. This measure also minimizes the danger of sensor damage as a result of mechanical stress or through unfavourable environmental influences such as wetness, dust, etc.

In another improvement, the first sensor part has a temperature sensor. Thus, the possibility exists to adapt the controlling of the tamping unit to operation conditions which are unfavourable due to temperature. For example, in the case of frost, a lowering procedure into the ballast bed takes place with an increased vibration frequency of the tamping tools.

The method according to the invention for operating the described tamping unit provides that measuring data or measuring signals of the sensor are transmitted to a control device, and that at least one drive of the tamping unit is controlled by means of the control device in dependence on the measuring data or measuring signals. Deviations from an optimal motion pattern are recognized immediately and lead to an adjustment of control signals in order to counteract interfering influences or unfavourable operating conditions.

In addition, it is useful if, during a calibration procedure of the sensor, the tamping unit in a raised state is operated with prescribed motion sequences. In this calibration mode, without being influenced by outer influences, the motions take place in a defined way so that the measuring data or measuring signals delivered by the sensor can be compared to the results to be expected.

The invention will be described below by way of example with reference to the accompanying drawings.

DETAILED DESCRIPTION OF THE INVENTION

Figure 1:
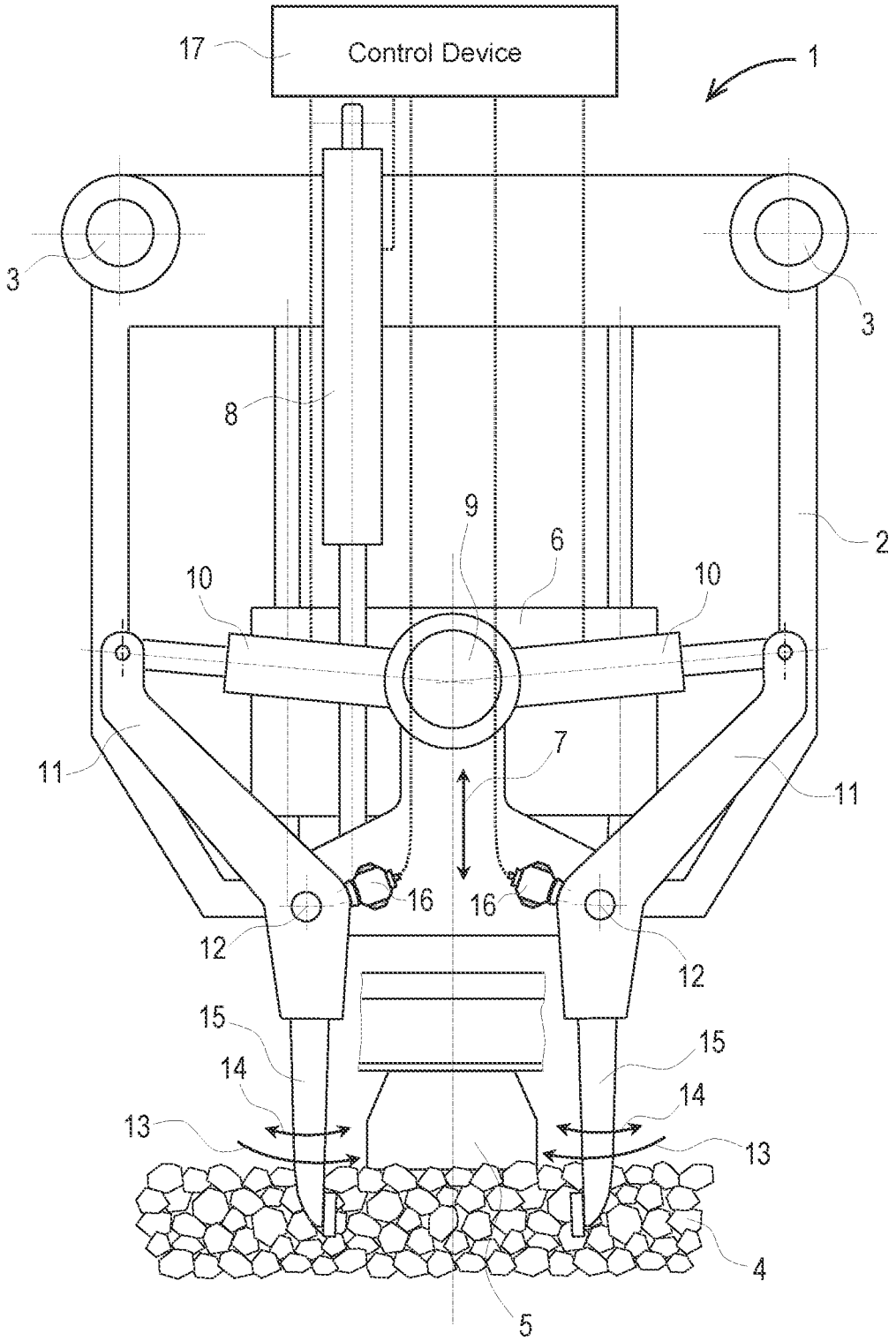
FIG. 1 a side view of a tamping unit

The tamping unit 1 shown in FIG. 1 includes an assembly frame 2 which is fastened to a machine frame of a track maintenance machine not further described. In the example shown, the mounting is designed for lateral displacement of the tamping unit 1 relative to the machine frame via two guides 3. In addition, the assembly frame 2 may be fastened to the machine frame for rotation about a vertical rotation axis in order to enable, if required, an adaptation of the position of the tamping unit to a sleeper 5 of a track lying obliquely in a ballast bed 4.

A tool carrier 6 is guided in a lowerable manner in the assembly frame 2, wherein a lowering- or lifting motion takes place by means of an associated lifting drive 8. Arranged on the tool carrier 6 is a vibration drive 9 to which two squeezing drives 10 are connected. Each squeezing drive 10 is connected to a pivot lever 11. Both pivot levers 11 are supported on the tool carrier 6 to be movable to one another about a respective horizontal pivot axis 12.

A rotatable eccentric drive is used, for example, as vibration drive 9, wherein an eccentricity defines a vibration amplitude and may be adjustable. A rotation speed determines the vibration frequency. The respective squeezing drive 10 is configured as a hydraulic cylinder and transmits the vibrations generated by the vibration drive 9 to the pivot levers 11. In addition, the respective squeezing drive 10 actuates the associated pivot lever 11 with a squeezing force during a tamping procedure. Thus, a vibration motion 14 is superimposed on a squeezing motion 13 during consolidation of the ballast bed 4. As an alternative to the variant shown, each squeezing drive 10 together with a vibration drive 9 can be designed as a hydraulic cylinder. Then, a cylinder piston carries out the squeezing motion 13 as well as the vibration motion 14.

Arranged at the lower end of the pivot lever 11 in each case is a tamping tool 15 (tamping tine). During a tamping procedure, the tamping tools 15 penetrate into the ballast bed 4 up to a lower sleeper edge and consolidate the ballast underneath the respective sleeper 5. FIG. 1 shows the tamping unit 1 during such a phase of the tamping operation. Subsequently, the tamping tools 15 are reset and lifted from the ballast bed 4. The tamping unit 1 is moved to the next sleeper 5 and the tamping procedure starts again. During resetting, lifting and moving onwards, the vibration motion 14 may be turned off. During penetrating into the ballast bed 4, however, a vibration motion 14 with higher frequency than during squeezing is useful in order to reduce the penetration resistance.

The described motion sequences follow an optimized motion pattern. To be able to recognize motion deviations and take countermeasures early, the tamping unit 1 is equipped with at least one sensor 16 for detecting motions. This sensor delivers measuring data or measuring signals to a control device 17 which is set up for controlling the tamping unit 1. In the example of embodiment shown, a sensor 16 is associated with each pivot lever 11.

Figure 2:
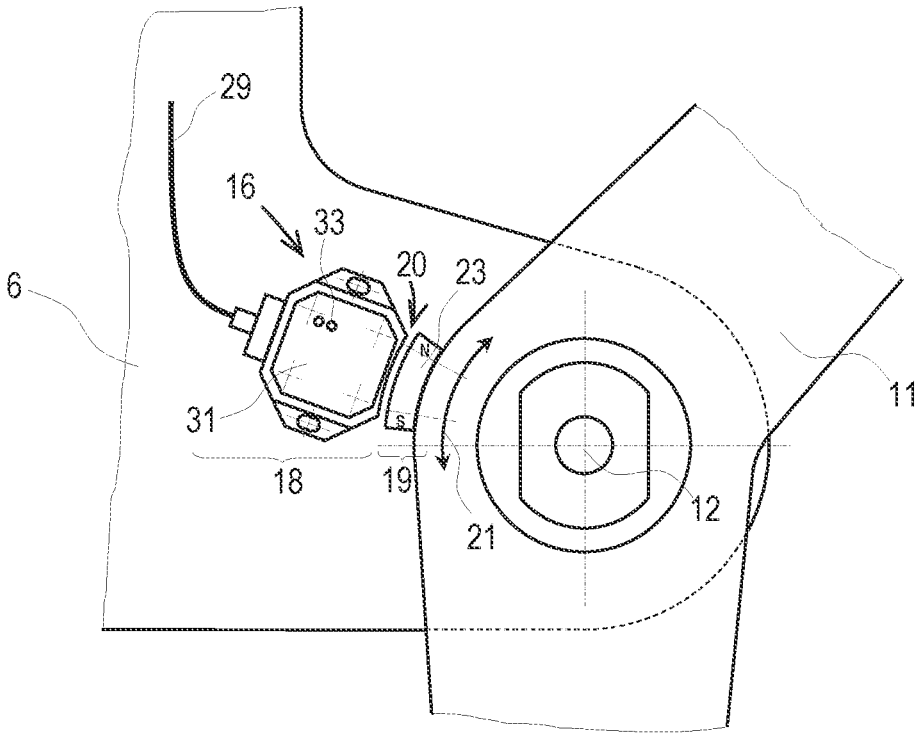
FIG. 2 an arrangement of the sensor at the tool carrier and at a pivot lever FIG. 3 a top view of the first sensor part without cover

The arrangement of a sensor 16 is visible in FIG. 2. The sensor 16 comprises a first sensor part 18 fastened to the tool carrier 6. Physically separate from this, a second sensor part 19 is fastened to the associated pivot lever 11. An air gap 20 of a few millimetres, ideally 5 mm, exists between the first sensor part 18 and the second sensor part 19. For example, the second sensor part 18 is arranged on an outer surface of the associated pivot lever 11 in the region of the pivot axis 12, so that it carries out pure pivoting motions 21 about the corresponding pivot axis 12. The first sensor part 18 is arranged lying opposite to the second sensor part 19. Pivoting motions 21 guide the second sensor part 19 past the first sensor part 18 without changing the distance in the air gap 20.

As active electronic component, the first sensor part 18 comprises a magnetic sensor 22 which faces the second sensor part 19. As passive component, the second sensor part 19 comprises a permanent magnet 23 (diametrical magnet). The north-south alignment of the latter extends in the direction of the pivoting motions 21 of the associated pivot lever 11. In this, the permanent magnet 23 extends over a maximum pivoting region of the pivot lever 11 (for example, maximally 22°) at the present fastening point of the permanent magnet 23. Thus, a surface of the permanent magnet 23 remains facing the magnetic sensor 22 over the entire pivoting region.

The magnetic sensor 22 detects the orientation of the magnetic field generated by means of the magnet 23 and computes from this a momentary angle position of the magnet 23 or the pivot lever 11 with respect to the magnetic sensor 22. In this, an angle zero position in a configuration mode is specified via a configuration menu. In addition, in the case of the magnet being mounted laterally, the input of a corresponding linearization factor is entered.

In another variant of the invention, the first sensor part 18 comprises a barcode scanner, and the second sensor part 19 is provided with a barcode. A pivoting motion 21 of the pivot lever 11 causes a displacement of the barcode relative to the barcode scanner.

The actual vibration frequency of the tamping tools 15 is determined from an angle signal measured by means of the sensor 16. During this, essentially three phases of a tamping cycle can be distinguished. During a lowering procedure, a vibration frequency of approximately 45 Hz is prescribed. During a squeezing procedure, a reduction to 35 Hz takes place. During lifting and moving onward of the tamping unit 1, the vibration is stopped or further reduced (to 20 Hz, for example). By means of the sensor 16, these vibration values are continuously checked in order to carry out control changes of the tamping unit 1 in the event of deviations.

Figure 3:
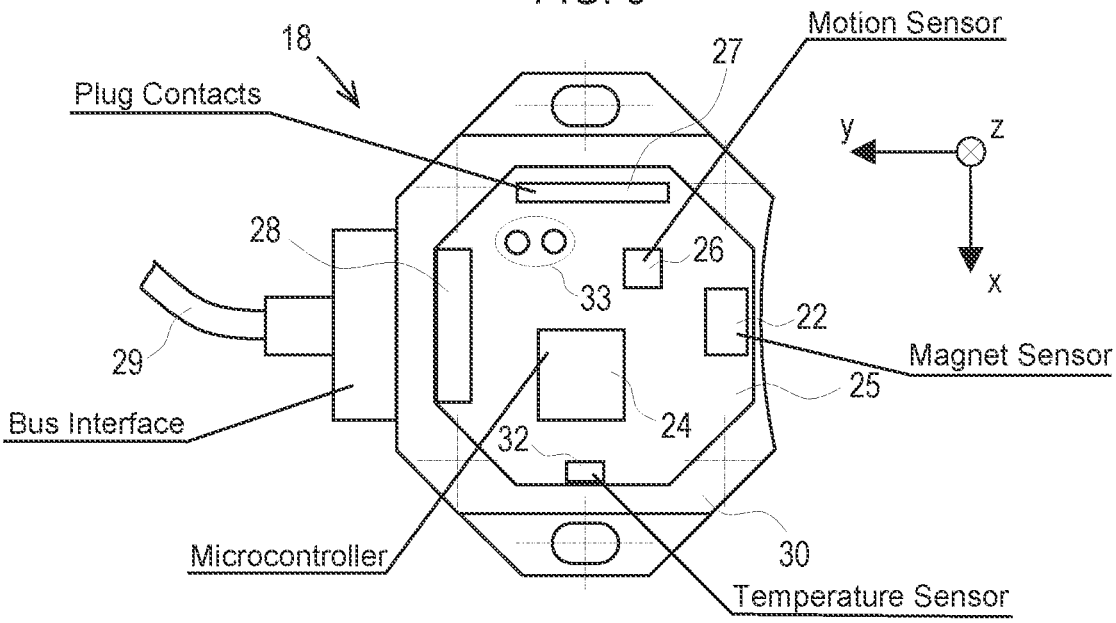

FIG. 3 shows a first sensor part 18 with the magnetic sensor 22 in detail. The magnetic sensor 22 is configured as an integrated component and, together with a microcontroller 24, is arranged on a circuit board 25. In addition, a motion sensor 26 is arranged on the circuit board 25. The same serves for recording all additional motions of the tamping unit 1. This is primarily the lowering- or lifting motion 7 of the tool carrier 6 including the pivot levers 11 and the tamping tools 15. However, a lateral motion, a forward motion or a rotary motion of the tamping unit 1 are also recorded by said motion sensor 26.

Advantageously, the motion sensor 26 also is designed as an integrated component and comprises three acceleration sensors as well as three gyroscopes. The motion sensor 26 comprises a DMP (Digital Motion Processor) and programmable digital low pass filters for pre-processing the recorded data. FIG. 3 shows an example of an axle orientation of the motion sensor 26. In this, the positive rotation directions result according to the right-hand helix rule. A respective acceleration measurement takes place along the x-, y- and z-axes. Usefully, several stages can be set for the measuring area (for example, ±2 g, 4 g, 8 g, 16 g). Angular velocities are measured about the x-, y- and z-axes. With these measuring values also, it is useful to be able to set various measuring areas (for example, ±250, 500, 1000, 2000 dps).

Further arranged on the circuit board 25 are plug contacts of a serial interface 27 (for example, RS-232). A data cable can be connected to these plug contacts in order to program or configure the sensor by means of a computer. In this, a suitable protocol is provided whereby the sensor 16 is set into a configuration mode by means of a corresponding start command. After configuration, an end command causes a return to an operating mode.

Additionally, a bus interface 28 is arranged on the circuit board 25. Via soldered or screwed contacts, a bus cable is connected to this bus interface 28 which is guided to the outside via an enclosure passage. Data communication with the control device 17 takes place via this bus interface 28. Programming or reconfiguration of the sensor 16 is also possible via this bus interface 28. Advantageously, this is a CAN interface to enable the integration into an existing CAN bus of a track maintenance machine. In this, it is possible via external tools (CAN viewer) to check whether the CAN interface functions.

All sensor values can be output separately and at different time intervals at the bus interface. During this, the output of digitalized measuring data takes place with a refresh rate which lies high above the prescribed vibration frequencies of the tamping tools 15. Optionally, the sensor 16 is also set up for outputting analogue measuring signals. For example, a respective measuring value is output as a voltage value between 0 and 10 volt, wherein here also there is a sufficiently high refresh rate (for example, 1 kHz).

Favourably, the bus cable 29 together with a supply line for current supply of the first sensor part 18 is guided through the sealed enclosure passage. Via this line, the first sensor part 18 is connected, for example, to a DC board net (for example, 24V DC) of a track maintenance machine. Also, a multipolar combined supply- and interface cable may be provided.

The circuit board 25 including the components 22, 24, 26, 27, 28 arranged thereon is housed in an enclosure 30. A cover 31 mounted by means of screw connections seals of the enclosure 30 off tightly. For example, rubber seals suited for the bus cable 29 are installed in the sealing gap of the cover and in the enclosure passage.

In addition, it is useful to fill up the enclosure with a casting resin before closing. In this way, the circuit board 25 and the electronic components 22, 24, 26, 27, 28 of the first sensor part 18 are additionally protected against moisture, dust and vibrations.

A temperature sensor 32 optionally arranged on the circuit board 25 is used to carry out temperature measurements and, in the event of changed conditions, to adjust the controlling of the tamping unit 1. During this, the heat emissions of the electronic components 22, 24, 26, 27, 28 are to be taken into account, if necessary. Particularly in the case of a completely cast circuit board 25, it may be useful as a result of a restricted heat dissipation to factor in an offset of the temperature.

A further advantageous extension of the sensor 16 concerns display elements 33. For example, different LEDs are arranged on the circuit board 25 which are visible through sealed recesses of the enclosure 30. These LEDs indicate whether the sensor 16 is running in normal operating mode, in configuration mode or in a fault operation. Also, a separate display device may be provided which is connected to the sensor 16 by a cable.

The various sensors 22, 26, 32 and the display elements 33 are connected to the microcontroller 24 via conductor paths of the circuit board 25. The microcontroller 24 reads out the connected sensors 22, 26, 32 and carries out a pre-processing of the measuring results.

The invention claimed is:

1. A tamping unit for tamping sleepers of a track, the tamping unit comprising:

an assembly frame;

a tool carrier supported and lowerable on said assembly frame;

two pivot levers mounted on said assembly frame, said pivot levers being squeezable toward one another, actuatable with a vibration and rotatable about a respective horizontal pivot axis, said pivot levers having tamping tools; and a sensor associated with at least one of said pivot levers for recording a pivot angle of a pivoting motion about said horizontal pivot axis, said sensor having a multipart configuration including a first sensor part fastened to said tool carrier and a second sensor part fastened to said pivot lever;

said first sensor part including a motion sensor being an integrated component, said motion sensor including three acceleration sensors and three gyroscopes, said first sensor part including a microcontroller, said first sensor part having a circuit board disposed in a sealed enclosure and cast in a protective medium, said first sensor part having a bus interface or a CAN interface, and said first sensor part having a bus cable connected to said bus interface and guided out of said sealed enclosure through a sealed passage; and said second sensor part being moveable about said horizontal pivot axis.

2. The tamping unit according to claim 1, wherein said first sensor part includes active electronic components, and said second sensor part includes passive components without any electricity supply.

3. The tamping unit according to claim 2, wherein said first sensor part includes a magnetic sensor, and said second sensor part includes a permanent magnet.

4. The tamping unit according to claim 1, which further comprises a serial interface disposed on said circuit board.

5. The tamping unit according to claim 4, wherein said serial interface has plug contacts for connection of a data cable.

6. The tamping unit according to claim 1, wherein said first sensor part has a temperature sensor.

* * * * *